United States Patent [19]

Abele

[11] 3,961,148

[45] June 1, 1976

[54] DRY-REED CONTACT CONSTRUCTION

[75] Inventor: Rolf Abele, Munich, Germany

[73] Assignee: Siemens Aktiengesellschaft, Berlin & Munich, Germany

[22] Filed: Oct. 23, 1974

[21] Appl. No.: 517,238

[30] Foreign Application Priority Data

Oct. 23, 1973 Germany ..... 2353124

[52] U.S. Cl. ..... 200/268; 29/191.6; 200/266; 204/37 R

[51] Int. Cl.[2] ..... H01H 1/02; C25D 5/50

[58] Field of Search ..... 204/37 R, 40, 36, 27; 29/196.3, 191.6, 191, 191.4; 148/31.5; 200/268, 266

[56] References Cited

UNITED STATES PATENTS

| | | | |
|---|---|---|---|
| 1,547,394 | 7/1925 | Hoyt | 204/37 R |
| 2,195,499 | 4/1940 | Schofield | 204/37 R |
| 3,251,121 | 5/1966 | Prival | 204/37 R |

*Primary Examiner*—T. M. Tufariello

[57] ABSTRACT

A dry-reed contact type of electrical switch is described. The dry-reed contacts have terminal elements constructed from a metal core having a copper covering. The terminal elements extend from the switch housing through fusible beads of printed glass in an airtight or gasproof manner. The material used for the metal core is selected to have an expansion coefficient corresponding to that of the fusible beads. The metal core is covered, first, by copper and then, by nickel in a quantity ratio equal to or slightly less than 1 part nickel to 5 parts copper. The terminal elements are exposed during the sealing process to a temperature of from 750° to 980° C. during a melting period of such duration that at least 85 percent of the quantity of nickel coating is diffused into the copper.

4 Claims, 2 Drawing Figures

DRY-REED CONTACT CONSTRUCTION

BACKGROUND OF THE INVENTION

The invention relates to dry-reed contacts using terminal elements having preferably a cylindrical metal core with a nickel and copper covering extending in an airtight manner from a metallic portion of the capsule over fusible beads of printed glass. A material is employed for the metal core which has an expansion coefficient matched to that of the printed glass used for the fusible beads of printed glass.

According to the technique heretofore employed for the manufacture of dry-reed contacts of the type referenced hereinabove, terminal elements are generally used having a metal core made from an iron/nickel alloy known under the trade name "Vacovit". The core is nickel-plated with a sheath thickness of about 5 micrometers and which is subsequently copper-plated with a sheath thickness of 2.5 micrometers. The expansion coefficient of the alloy for the metal core is matched to that of the printed glass used for the fusible beads of printed glass, so that no capillary cracks arise in the vitreous coating, which would endanger the gas density. These cracks usually result from unavoidable temperature variations in industrial applications of dry-reed contacts. Of the above mentioned coatings vapor-deposited or, preferably, electro-deposited on the metal core, the nickel sheath is applied to ensure an excellent vitreous coating, and the copper sheath facilitates the subsequent tin-plating of the portion of the terminal elements jutting out of the enclosing case.

The foregoing prior art technique has the drawback that the comparatively thin copper sheath diffuses mainly into the nickel coating during the sealing process when the terminal elements are placed in the capsule, so that at the end of the sealing process the surface of the terminal element has a very high nickel content. The presence of this high nickel content during the further manufacturing process, and particularly if the dry-reed contact has been stored a long time, leads to rust formation and makes it very difficult for the terminal elements to be tin-plated and for electrical lines to be soldered thereto later.

To overcome the foregoing problem it is obvious that one should attempt as a first step to reduce the diffusion time of the copper into the nickel coating. However, this remedy is inadequate, because the total time of the melting process cannot for obvious reasons (necessary preheating of the entire contact or at least of the melting zone, softening of the fusible bead or printed glass, etc.) be reduced arbitrarily.

Another remedy for overcoming the above shortcomings is to make the copper coating substantially thicker so as to obtain an adequate copper sheath on the surface of the terminal element, even if the melting process exceeds the minimum period. However, attempts in this direction with terminal elements covered by a comparatively thick copper coating (copper-clad wires customarily available in the trade) also yield negative results, because the above necessary reaction of the nickel coating could not take place so as to result in a gasproof glaze, and the surface remaining after the diffusion, which contained a large amount of copper, obviously did not yield the absolutely necessary gasproof glaze which can assuredly be obtained if the surface contains an adequate amount of nickel.

It is an object of this invention to solve the problems described hereinabove and to provide terminal elements for dry-reed contacts of the type mentioned hereinabove which ensure a hermetically sealed glaze and, insure the possibility of tin-plating with ease the terminal elements for subsequent soldering.

SUMMARY OF THE INVENTION

In accordance with the invention, the foregoing and other objects are achieved in that terminal elements are employed, whose metal cores are covered in sequence first by copper, then by nickel, in a quantity ratio equal to or slightly less than 1 part nickel to 5 parts copper. The terminal elements are exposed during the sealed process to a temperature in the usual order of magnitude between about 750° and 980° during a melting time of such duration that at least 85 percent of the quantity of the nickel coating is diffused into the copper skin.

In contradistinction to the prior technique, in which the nickel needed for a closely connected glaze must diffuse outwardly through the outer copper coating in the period for the melting process required for the glaze, due to the above described structure of the terminal elements nickel is present in adequate quantities as outer coating so that a connection is ensured between the printed glass and the terminal elements or metallic area of the enclosing case and the very thin outer nickel coating diffuses, during the further melting process, so far into the copper sheath lying therebelow that in the end the surface of the terminal elements has such a high copper content that the surface can easily be tin-plated even after long storage. Thus, the primary object of the invention is achieved.

According to a further development of the invention, the duration of the melting time is calculated in conformity with the diffusion per unit of time occurring at a given melting temperature, such that a residual proportion of the nickel coating on the surface of the copper skin remains within 5 to 10 percent of the initial quantity of nickel. Thus, if substantially the same excess of copper is maintained on the surface of the terminal elements, a proportion of nickel is still obtained that is adequate for the lines, where necessary, to be welded electrically instead of tin-plated and soldered.

According to one form of construction of the invention, the terminal elements are conveniently made, preferably electrochemically, as sections of a copper-clad wire covered on their surfaces with a nickel coating. The metal core of the copper-clad wire comprises an iron-nickel alloy and is coated with a copper sheath. The particular advantage of this construction is seen in the fact that the terminal elements can be made from a starting material customarily available in the trade and, therefore, inexpensive, and they can be made in suitable lengths relatively easily and with a simple tool.

Based on the last mentioned arrangement, a preferred form of construction of the terminal elements is achieved by employing, according to a further development of the invention, terminal elements comprising a core made from an iron-nickel alloy known under the trade name "Vacovit", which is sheathed all around by a copper jacket about 50 micrometers thick and coated on its surface with a nickel sheath between 0.2 and 2 micrometers. The copper jacket and the nickel sheath are connected, respectively, mechanically adhering and electrically conducting with their substratum. This form of construction has proved to be fully efficacious during practical tests conducted with a view to achieving the object of the invention and, in addition, encounters no particular technical difficulties during the fabrication.

BRIEF DESCRIPTION OF THE DRAWINGS

The principles of the invention will be more readily understood by reference to the description of a preferred embodiment given hereinbelow in conjunction with the two-figure drawing which is a schematic diagram of a dry-reed contact constructed according to the invention.

DETAILED DESCRIPTION OF THE DRAWINGS

Figure 1:
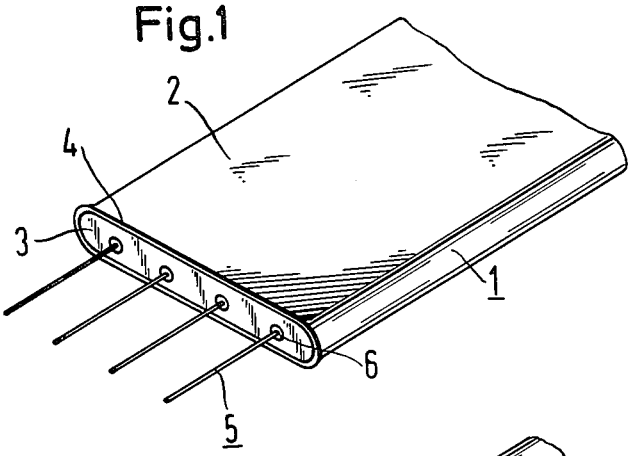
FIG. 1 is a dry-reed contact cartridge of known construction shown axonometrically.

Reference numeral 1 is FIG. 1 denotes a dry-reed contact cartridge comprising a metallic enclosing case 2 and two end closing plates 3, each being welded gasproof, or in an airtight manner, with the enclosing case 2 over a beaded edge 4. Contact means, not shown in detail, are disposed within the contact cartridge. Reference numeral 5 donotes terminal elements inserted in a gasproof manner into the end closing plates 3 by means of fusible beads 6 of printed glass. The terminal elements 5 are electrically connected within the contact cartridge, in a manner not shown, to the contact means and serve with their free ends jutting out of the enclosing case for the subsequent connection to electrical lines. The free ends of the terminal elements, where necessary, can also be bent and inserted into the perforations of a circuit board and soldered therein, as a result of which they serve at the same time for mechanically holding the contact cartridge.

Figure 2:
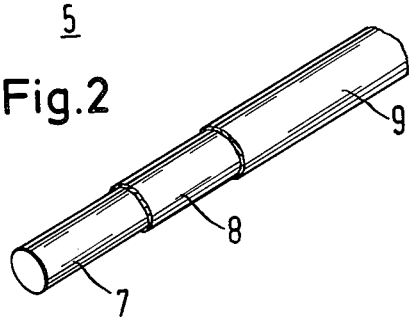
FIG. 2 is an enlarged view of a terminal element, partially broken away.

FIG. 2 is an enlarged view of one of the terminal elements in the device of FIG. 1. Reference numeral 7 denotes a metal core, whose material has an expansion coefficient that is matched to that of the printed glass used for the fusible beads 6 of printed glass. By way of example, a material consisting of an iron-nickel alloy and known under the trade name "Vacovit" may be used for this purpose. The metal core 7 is covered by a copper coating 8, and the metal core, thus sheathed, is finally coated on its surface with a very thin nickel sheath 9.

The preferred embodiment of the invention described hereinabove is intended only to be exemplary of the principles of the invention. It is contemplated that the described embodiment can be modified or changed while remaining within the scope of the invention as defined by the appended claims.

I claim:

1. A dry-reed contact electric switch having terminal elements constructed of a metal core having a nickel and copper covering, which terminal elements extend from a housing for said switch in an airtight manner through fusible glass beads, said metal core having a coefficient of expansion matched to that of said glass forming said fusible beads, wherein said terminal elements are formed in accordance with the following steps:

covering said metal core in sequence with a sheath of copper and then with a sheath of nickel in a quantity ratio equal to or slightly less than 1 part nickel to 5 parts copper and exposing said terminal elements, so covered, to a temperature of from 750° to 980° C. during a melting period of such duration that at least 85 percent of said nickel sheath is diffused into said copper sheath.

2. The dry-reed contact switch defined in claim 1 wherein said terminal elements are formed according to the additional step of:

determining the duration of said melting time so that it is in conformity with the diffusion per unit of time occurring at a given melting temperature such that a residual portion of said nickel sheath which remains on the surface of said copper sheath is within 5 to 10 percent of the initial quantity of nickel.

3. The dry-reed contact switch defined in claim 1 wherein said metal core is an iron-nickel alloy and wherein said covering step is performed electrochemically.

4. The dry-reed switch defined in claim 3 wherein said copper sheath has a thickness of substantially 50.0 micrometers and said nickel sheath has a thickness of from 0.2 to 2.0 micrometers and wherein said terminal elements are formed according to the additional step of:

mechanically and electrically connecting said copper and nickel sheaths, respectively, to said metal core.

* * * * *